US006561766B2

(12) United States Patent
Nishimura et al.

(10) Patent No.: US 6,561,766 B2
(45) Date of Patent: May 13, 2003

(54) OIL FREE SCREW COMPRESSOR OPERATING AT VARIABLE SPEEDS AND CONTROL METHOD THEREFOR

(75) Inventors: Hitoshi Nishimura, Shimizu (JP); Hiroshi Ohta, Shimizu (JP)

(73) Assignee: Hitachi, Ltd., Tokyo (JP)

( * ) Notice: Subject to any disclaimer, the term of this patent is extended or adjusted under 35 U.S.C. 154(b) by 15 days.

(21) Appl. No.: 09/819,999

(22) Filed: Mar. 29, 2001

(65) Prior Publication Data

US 2002/0051709 A1 May 2, 2002

(30) Foreign Application Priority Data

Oct. 31, 2000 (JP) ..... 2000-337250

(51) Int. Cl.[7] ..... F04B 49/06

(52) U.S. Cl. ..... 417/44.2; 417/243; 417/252; 417/253; 417/310

(58) Field of Search ..... 417/44.2, 243, 417/252, 251, 253, 298, 310, 302

(56) References Cited

U.S. PATENT DOCUMENTS 1,422,376 A * 7/1922 Richards ..... 417/252
1,612,639 A * 12/1926 Metzgar ..... 417/253
3,216,648 A * 11/1965 Ford ..... 248/466
3,367,562 A * 2/1968 Persson et al. ..... 417/295
4,815,950 A * 3/1989 Aoki et al. ..... 417/253
5,195,874 A * 3/1993 Odagiri ..... 417/243

* cited by examiner

*Primary Examiner*—Cheryl J. Tyler
(74) *Attorney, Agent, or Firm*—Antonelli, Terry, Stout & Kraus, LLP

(57) ABSTRACT

An oil free screw compressor includes a low-pressure stage compressor body and a high-pressure stage compressor body. Power of a motor driven by an inverter is transmitted to the compressor bodies through gears. A low-pressure stage blow-off two-way valve is provided in a pipe branching off midway an air pipe connecting between the high-pressure stage compressor body and the low-pressure stage compressor body, and a high-pressure stage blow-off two-way valve is provided in a pipe branching off from a discharge air pipe provided on a discharge side of the high-pressure stage compressor body. During no-load operation, a controller gives a command to the inverter to make the rotational speed of the motor a set lower limit rotational speed, and also gives an open command to the low-pressure stage blow-off two-way valve.

18 Claims, 4 Drawing Sheets

OIL FREE SCREW COMPRESSOR OPERATING AT VARIABLE SPEEDS AND CONTROL METHOD THEREFOR

BACKGROUND OF THE INVENTION

The present invention relates to a variable rotational speed oil free screw compressor and a control method therefor and, more particularly, to a variable rotational speed oil free screw compressor having a low-pressure stage compressor body and a high-pressure stage compressor body and a control method therefor.

In a conventional variable rotational speed oil free screw compressor, for example, as disclosed in Japanese Patent Laid-Open No. 82391/1998, a low-pressure stage screw compressor body and a high-pressure stage screw compressor body are connected to each other in series, and a cooler is provided between the two compressing sections. A motor is connected to each of the low-pressure stage screw compressor body and the high-pressure stage screw compressor body, and the motor is driven at a variable speed by an inverter. In the variable rotational speed oil free screw compressor constructed above, with a small flow rate, both of the low-pressure stage screw compressor body and the high-pressure stage screw compressor body rotate at low speed, so that an amount of internal leakage cannot be ignored. Therefore, a blow-off valve is connected to an outlet pipe, by which blow-off control is carried out while the low-pressure stage screw compressor body and the high-pressure stage screw compressor body are operated at the lowest rotational speed.

With an oil free screw compressor having two stages of low-pressure and high-pressure stages, power consumption with no load is smaller than that with full load as compared with a single-stage oil free screw compressor. Therefore, even if the method disclosed in the above-described Publication is applied at the time of no-load operation, there is a disadvantage that power consumption is not decreased so much as compared with a conventional method, in which a suction throttle valve is throttled.

BRIEF SUMMARY OF THE INVENTION

The present invention has been contrived in view of the above problems of the prior art, and has its object to provide a variable rotational speed oil free screw compressor having a low-pressure stage compressor body and a high-pressure stage compressor body, in which power consumption is reduced both at no load and at low load.

A first feature of the present invention for attaining the above object is a variable rotational speed oil free screw compressor, comprising a low-pressure stage compressor body and a high-pressure stage compressor body, which are variable in rotational speed, and blow-off means for blowing off compressed air to the atmosphere midway a pipe connecting between the high-pressure stage compressor body and the low-pressure stage compressor body. In this feature, it is preferable that an inter-cooler and blow-off means is provided midway the pipe connecting between the high-pressure stage compressor body and the low-pressure stage compressor body, and an after-cooler is provided on a discharge side of the high-pressure stage compressor body. Also, another blow-off valve may be provided between the high-pressure stage compressor body and a check valve to blow off compressed air discharged from the high-pressure stage compressor body, and wherein compressed air is blown off through the blow-off valve and another blow-off valve at the time of no-load or low-load operation.

Also, a pressure detector may be provided on the discharge side of the high-pressure stage compressor body for detecting pressure of high-pressure air discharged from the high-pressure stage compressor body, and a controller may be provided to receive a signal of discharge pressure detected by the pressure detector and output a control signal for controlling the blow-off means. The variable rotational speed oil free screw compressor may further comprise an electric motor for rotatingly driving the low-pressure stage compressor body and the high-pressure stage compressor body, and an inverter for driving the electric motor, and wherein the controller controls the inverter based on a signal of discharge pressure detected by the pressure detector.

Preferably, a suction throttle valve is provided on a suction side of the low-pressure stage compressor body, and another blow-off means is provided on a discharge side of the high-pressure stage compressor body, another blow-off means interconnecting with the suction throttle valve.

A second feature of the present invention for attaining the above object is a method of controlling a variable rotational speed oil free screw compressor adapted to operate in accordance with a volume of consumed air on a usage side while changing rotational speeds of a low-pressure stage compressor body and a high-pressure stage compressor body, the method comprising the steps of: performing a load operation to change rotational speeds of the low-pressure stage compressor body and the high-pressure stage compressor body in a region, in which a volume of consumed air based on pressure detected by a pressure detector provided on a discharge side ranges from a maximum air volume to a preset volume of air; operating the low-pressure stage compressor body and the high-pressure stage compressor body at set lower limit rotational speeds preset every compressor body in a no-load operation, in which a volume of consumed air is substantially zero, and blowing off compressed air from blow-off means provided in a pipe connecting between the high-pressure stage compressor body and the low-pressure stage compressor body; and repeating the load operation and the no-load operation when a volume of consumed air is equal to or smaller than a set air volume.

Preferably, during the load operation, the rotational speeds of the low-pressure stage compressor body and the high-pressure stage compressor body are changed substantially in proportion to a volume of consumed air. Also preferably, during no-load operation, compressed air discharged from the high-pressure stage compressor body is blown off.

A third feature of the present invention for attaining the above object is a method of controlling a variable rotational speed oil free screw compressor adapted to operate in accordance with a volume of consumed air on a usage side while changing rotational speeds of a low-pressure stage compressor body and a high-pressure stage compressor body, the method comprising the steps of: performing operations including a no-load operation to blow off compressed air from blow-off means provided in a pipe connecting between the high-pressure stage compressor body and the low-pressure stage compressor body when a volume of consumed air based on pressure detected by a pressure detector provided on a discharge side is not exceeding a preset volume of air and pressure of compressed air discharged from the low-pressure stage compressor body is at least the atmospheric pressure.

A suction throttle valve provided on a suction side of the low-pressure stage compressor body may be made to interlock with blow-off means for compressed air compressed by the high-pressure stage compressor body to make control to throttle the suction throttle valve when a volume of consumed air is not exceeding a set air volume.

DETAILED DESCRIPTION OF THE PREFERRED EMBODIMENTS

Figure 1:
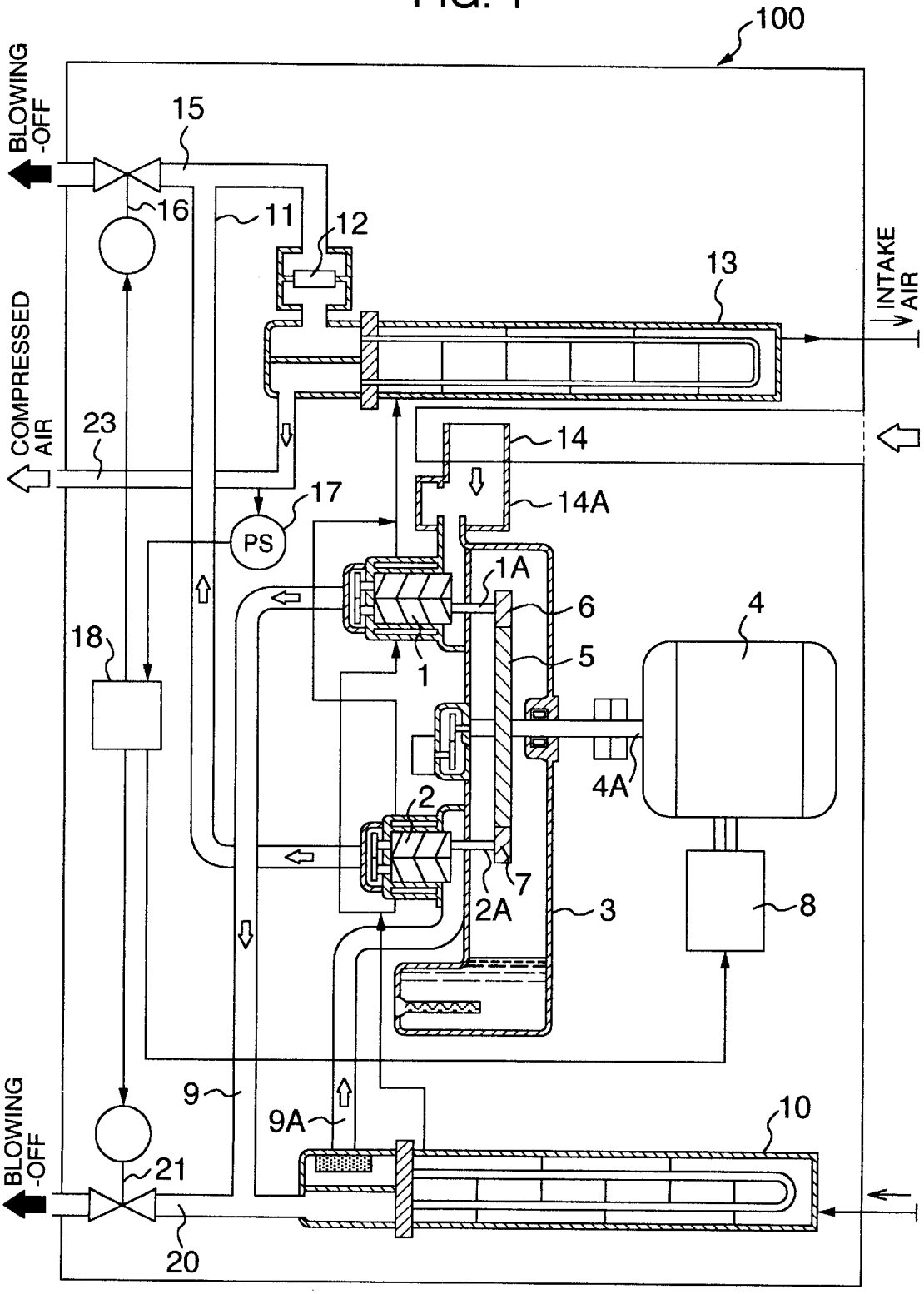
FIG. 1 is a schematic view showing one embodiment of an inverter driven type oil free screw compressor in accordance with the present invention.
Figure 2:
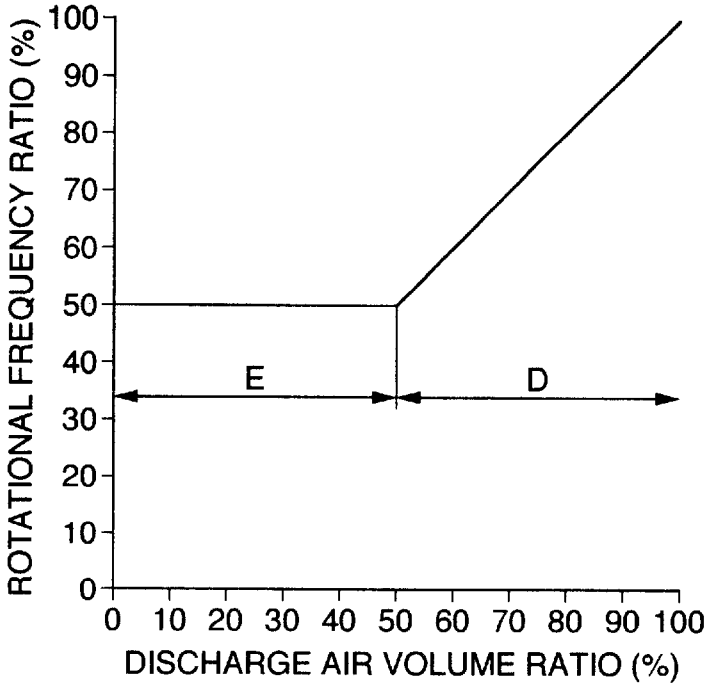
FIG. 2 is a graph for illustrating an operation method of the oil free screw compressor shown in FIG. 1.
Figure 3:
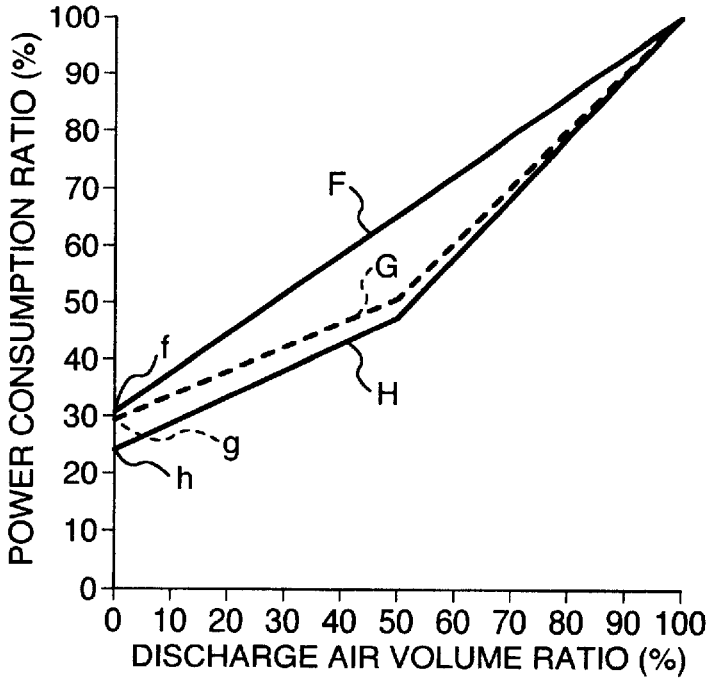
FIG. 3 is a graph for illustrating power consumption characteristics of the oil free screw compressor shown in FIG. 1.

Several embodiments of the present invention will now be described with reference to the accompanying drawings. FIG. 1 is a schematic view of an oil free screw compressor, and FIGS. 2 and 3 are graphs for illustrating an operation method of the oil free screw compressor shown in FIG. 1.

Referring to FIG. 1, an oil free screw compressor 100 has a low-pressure stage compressor body 1 and a high-pressure stage compressor body 2. With the low-pressure stage compressor body 1, a pair of male and female rotors are held in a casing formed at an outer periphery thereof with a cooling jacket. The paired rotors are rotated in synchronism by engagement of timing gears mounted at shaft ends of the respective rotors. A pinion gear 6 is mounted at an end of a rotating shaft 1A of one of the rotors on an opposite side to an end, at which the timing gear is mounted. Likewise, with the high-pressure stage compressor body 2, a pair of male and female rotors is held in a casing formed at an outer periphery thereof with a cooling jacket. The paired rotors are rotated in synchronism by engagement of timing gears mounted at shaft ends of the respective rotors. A pinion gear 7 is mounted at an end of a rotating shaft 2A of one of the rotors on an opposite side to an end, at which the timing gear is mounted.

The two pinion gears 6 and 7 mesh with a bull gear 5 mounted on a bull shaft coupling-connected to a rotating shaft 4A of a motor 4. The motor 4 is a variable speed type motor driven by an inverter 8. The pinion gears 6 and 7 and the bull gear 5 are housed in a gear casing 3. The lower part of the gear casing 3 forms an oil sump for a lubricating oil that lubricates bearings of the compressor bodies 1 and 2, the bull gear 5, and the pinion gears 6 and 7.

Mounted in a suction flow path of the low-pressure stage compressor body 1 is a filter 14 to filter and supply ambient air to the low-pressure stage compressor body 1, and a suction port 14A is formed on a downstream side of the filter 14. Provided between a discharge side of the low-pressure stage compressor body 1 and a suction side of the high-pressure stage compressor body 2 is an inter-cooler 10, which is connected to the low-pressure stage compressor body 1 through an air pipe 9 and is connected to the high-pressure stage compressor body 2 through an air pipe 9A. An after-cooler 13 is connected to a downstream side of the high-pressure stage compressor body 2 through an air pipe 11 via a check valve 12.

A low-pressure stage blow-off pipe 20 branches off midway the air pipe 9 that connects the inter-cooler 10 to the low-pressure stage compressor body 1. The low-pressure stage blow-off pipe 20 is provided with a low-pressure stage blow-off two-way valve 21. Likewise, a high-pressure stage blow-off pipe 15 branches off from an upstream side of the check valve 12 and midway the air pipe 11 that connects the after-cooler 13 to the high-pressure stage compressor body 2. The high-pressure stage blow-off pipe 15 is provided with a high-pressure stage blow-off two-way valve 16. In order to supply the usage side with compressed air having been cooled by the after-cooler 13, a discharge air pipe 23 is provided on a downstream side of the after-cooler 13. A pressure detector 17 is mounted midway the discharge air pipe 23 to measure pressure of compressed air discharged from the oil free screw compressor 100. The pressure detected by the pressure detector 17 is input into a controller 18.

An explanation will be given below to the operation of the embodiment configured as described above. When the motor 4 is operated, torque of the motor 4 is transmitted to the low-pressure stage compressor body 1 and the high-pressure stage compressor body 2 via the bull gear 5 and the pinion gears 6 and 7. Thereby, the pairs of rotors provided on the low-pressure stage compressor body 1 and the high-pressure stage compressor body 2 are rotated in synchronism to compress an air being a working gas. The ambient air for compression, having been sucked through the suction port 14A, is compressed in the low-pressure stage compressor body 1 to be raised in temperature and pressure. This high-temperature compressed gas is introduced to the inter-cooler 10 through the air pipe 9 to be cooled by the inter-cooler 10. The compressed air having been cooled by the inter-cooler 10 is introduced into the high-pressure stage compressor body 2 through the air pipe 9A to be raised in temperature and further increased to a predetermined discharge pressure. The compressed air having been raise in temperature is introduced into the after-cooler 13 through the air pipe 11 to be cooled in the after-cooler 13, and then supplied to the usage side through the discharge air pipe 23.

When a volume of consumed air on the usage side decreases, discharge pressure detected by the pressure detector 17 rises. This detected discharge pressure is input into the controller 18. When the discharge pressure rises, the controller 18 outputs a command signal to the inverter 8 to decrease the rotational speed of the motor 4. When the rotational speed of the motor 4 decreases, the rotational speeds of the rotors provided on the low-pressure stage compressor body 1 and the high-pressure stage compressor body 2 decrease, so that a volume of air discharged from the oil free screw compressor 100 decreases.

More specifically, when the volume of consumed air reduces and a volume of air discharged from the oil free screw compressor 100 is allowed to be 100% to about 50% of the specified volume of discharged air, the controller 18 controls the rotational speed of the motor 4 in proportion to the discharged air volume ratio as shown in FIG. 2 (operation range D) in order to make discharge pressure constant. In contrast, when a volume of discharged air is allowed to be about 50% or less of the specified volume of discharged air, the controller 18 commands a blow-off decompressing operation. Concretely, if discharge pressure detected by the pressure detector 17 exceeds a set upper limit pressure preset in the controller 18, the controller 18 gives a command to the inverter 8 to maintain a set lower limit rotational speed. At the same time, the controller 18 gives an open command to the high-pressure stage blow-off two-way valve 16. Opening of the high-pressure stage blow-off two-way valve 16 permits the compressed air having been compressed in the high-pressure stage compressor body 2 to be released to the atmosphere without introduction into the after-cooler 13.

With the embodiment, the air pipe 20 is provided to branch off midway the air pipe 9 on the discharge side of the low-pressure stage compressor body 1. The low-pressure stage blow-off pipe 20 is provided with a low-pressure stage blow-off two-way valve 21. The reason for this is as follows. A range that a volume of air discharged from the oil free screw compressor 100 is 100% to about 50% of the specified volume of discharged air is a region of load operation. Since it is desired in this load operation region to supply an entire volume of compressed air to the usage side, the controller 18 gives a command to the low-pressure stage blow-off two-way valve 21 to close the low-pressure stage blow-off two-way valve 21. Thereby, the entire volume of compressed air compressed by the low-pressure stage compressor body 1 is supplied to the high-pressure stage compressor body 2.

At the time of no-load operation, when consumption of compressed air on the usage side decreases and it becomes unnecessary to supply compressed air to the usage side, the controller 18 gives a command to the inverter 8 to make the rotational speeds of the low-pressure stage compressor body 1 and the high-pressure stage compressor body 2 set lower limit values. At the same time, the controller 18 gives an open command to the low-pressure stage blow-off two-way valve 21 to release a part of compressed air compressed by the low-pressure stage compressor body 1 to the atmosphere.

When a volume of compressed air supplied to the usage side is less, that is, at the time of low-load operation, in which a volume of discharged air is about 50% and less of the specified volume of discharged air, the controller 18 gives a command to the inverter 8 to make the rotational speeds of both the low-pressure stage compressor body 1 and the high-pressure stage compressor body 2 at most set lower limit values. The controller 18 controls the low-pressure stage blow-off two-way valve 21 and the high-pressure stage blow-off two-way valve 16 so that the above-described no-load operation and load operation are repeated. In either of the above-described operations, a volume of compressed air consumed is determined based on pressure detected by the pressure detector 17 provided in the discharge air pipe 23.

FIG. 3 shows a change in power consumption of the oil free screw compressor 100 when the controller 18 controls the inverter 8, the low-pressure stage blow-off two-way valve 21 and the high-pressure stage blow-off two-way valve 16 as described above. In FIG. 3, an abscissa represents values obtained by dividing a volume of discharge air of the oil free screw compressor by a volume of discharged air used, and an ordinate represent power consumption of the oil free screw compressor assuming power consumption to be 100% when a volume of discharge air corresponds to a volume of air used. A line F in FIG. 3, drawn for comparison, indicates changes in power consumption in the case where a conventional capacity control method is used, in which a suction throttle valve adapted to open and close in accordance with load is provided on a suction side of the low-pressure stage compressor body 1. In this control method, both the low-pressure stage compressor body 1 and the high-pressure stage compressor body 2 are operated with the rotational speeds being constant, and compressed air is blown off upon no-load operation. A point f indicates power consumption at the time of no-load operation when the conventional capacity control method is used.

Also, a line G in FIG. 3, drawn for comparison with the present invention, indicates changes in power consumption of a variable rotational speed oil free screw compressor without a low-pressure stage blow-off two-way valve but with only a high-pressure stage blow-off two-way valve 16. This conventional oil free screw compressor comprises a low-pressure stage compressor body and a high-pressure stage compressor body, each of the compressor bodies is operated by an inverter-driven motor. A point g indicates power consumption at the time of no-load operation when the conventional rotational speed control method is used.

A line H in FIG. 3 indicates power consumption characteristics of an oil free screw compressor, to which the control method according to the present invention is applied. When the discharge air volume ratio is 100% to 50%, power consumption changes in proportion to the discharge air volume ratio. When the discharge air volume ratio is 50% or less, the change is more gradual than that at the time of large flow rates (100% to 50%), but power consumption is less than that in the case of the lines F and G for the prior art. Moreover, a point h indicating power consumption at the time of no-load operation is apparently below the points f and g.

Hereupon, power consumption of an oil free screw compressor is a sum of power required for compressing air and a mechanical loss generated at bearings or the like. At the time of no-load operation, the rotational speed of a compressor body is controlled to be approximately a half of the rotational speed at the time of full-load operation, so that a ratio of mechanical loss is small and most of power consumption is allotted to compression of air. In this embodiment, since a part of compressed air compressed by the low-pressure stage compressor body is blown off to the atmosphere at the time of no-load operation, a volume of compressed air supplied to the high-pressure stage compressor body decreases by the volume of blown-off air. Since power consumed caused by air compression is substantially in proportion to a volume of air sucked by the compressor body, power consumption due to air compression in the high-pressure stage compressor body becomes approximately a half assuming that 50% of compressed air compressed by the low-pressure stage compressor body is blown off. Therefore, when power consumption due to air compression is substantially the same in the low-pressure stage compressor body and the high-pressure stage compressor body in full-load operation, power consumption due to air compression in the low-pressure stage compressor body and the high-pressure stage compressor body can be reduced by 25% if 50% of compressed air compressed by the low-pressure stage compressor body is blown off.

Since a two-stage compressor is generally higher in unload efficiency than a single-stage compressor, power consumption of the two-stage compressor at no load is relatively less than that of the single-stage compressor. Therefore, a difference becomes very small between power consumption at no load in the conventional capacity control method (point f) and power consumption at no load in the rotational speed control method (point g). On the other hand, according to this embodiment, in a region, in which a volume of discharge air is small as shown in FIG. 3, compressed air compressed by the low-pressure stage compressor body is blown off to the atmosphere to decrease compression work of the high-pressure stage compressor body, so that power consumption is reduced. In addition, when a two-stage oil free screw compressor having a low-pressure stage compressor body and a high-pressure stage compressor body, which are constant in rotational speed, is subjected to capacity control with the use of a suction throttle valve, pressure of compressed air discharged from the low-pressure stage compressor body becomes negative, so that it is difficult to blow off compressed air compressed by the low-pressure stage compressor body to the atmosphere.

Figure 4:
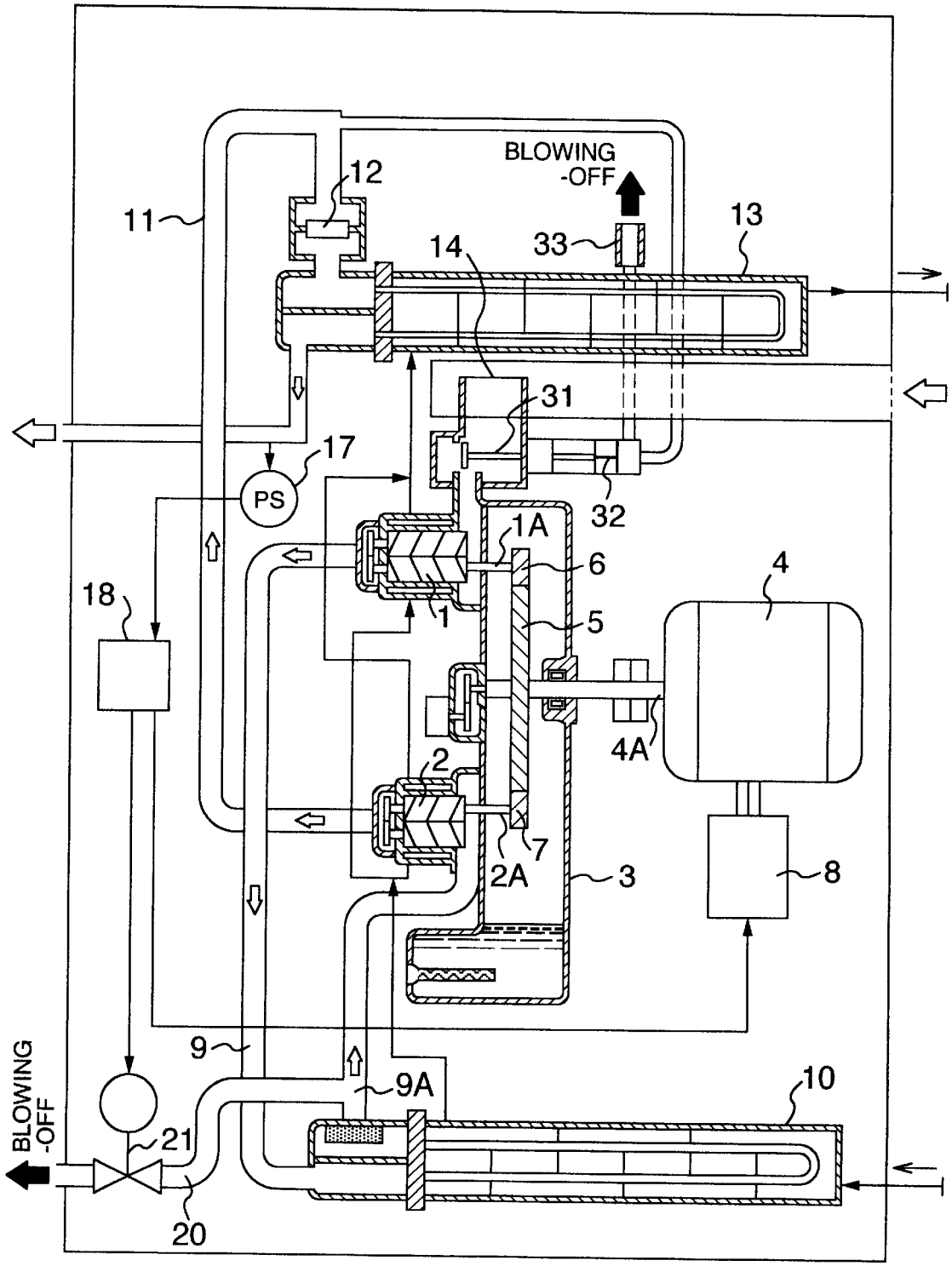
FIG. 4 is a schematic view showing another embodiment of an inverter driven type oil free screw compressor in accordance with the present invention.
Figure 5:
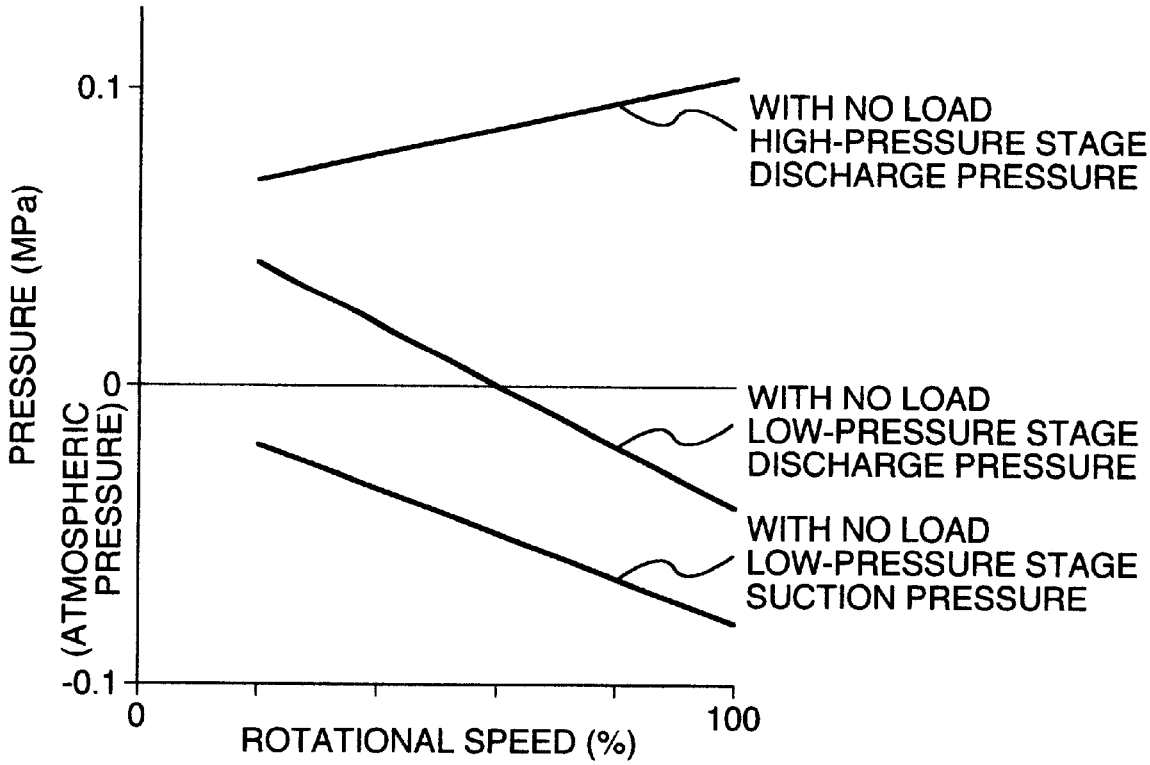
FIG. 5 is a graph for illustrating pressure characteristics of the oil free screw compressor shown in FIG. 4 at the time of no-load operation.

Next, another embodiment of the present invention will be described with reference to FIGS. 4 and 5. FIG. 4 is a general schematic view showing an inverter driven type oil free screw compressor according to the present invention, and FIG. 5 is a graph showing changes in discharge pressure when the oil free screw compressor shown in FIG. 4 is operated at different rotational speeds. This embodiment differs from the embodiment shown in FIG. 1 in that a suction throttle valve 31 is provided at a suction port of the low-pressure stage compressor body 1, a blow-off valve 32 adapted to interconnect with opening and closing of the suction throttle valve 31 is provided in place of the high-pressure stage blow-off two-way valve 16, and a blow-off silencer 33 is provided on a secondary side of the blow-off valve 32.

With the embodiment constructed in the above manner, at the time of load operation, in which compressed air is supplied to the usage side, the controller 18 gives a command to the inverter 8 to indicate the rotational speed of the motor 4 so that the oil free compressor can supply a volume of air needed on the usage side, which volume is obtained based on discharge pressure detected by the pressure detector 17. At the same time, the controller gives a command to open the suction throttle valve 31.

At the time of no-load operation, in which compressed air is not supplied to the usage side, the controller 18 gives a command to close the suction throttle valve 31, and also gives a command to the inverter 8 to make the rotational speed of the motor 4 a set lower limit rotational speed. Further, the controller 18 also gives a command to open the blow-off valve 32. Since the rotational speed of the low-pressure stage compressor body 1 is the set lower limit rotational speed at the time of no-load operation, suction pressure of the low-pressure stage compressor body 1 on a secondary side of the suction throttle valve 31 decreases when a volume of air sucked by the low-pressure stage compressor body 1 reduces. However, since a large-sized suction throttle valve 31, for example, for 100 kW in the two-stage compressor of 22 kW is used for common use, pressure on the suction side does not decrease extremely even when the suction throttle valve 31 is throttled. As a result, discharge pressure of the low-pressure stage compressor body 1, which assumes a value obtained by multiplying the suction pressure by a pressure ratio, can be made positive. Therefore, compressed air compressed by the low-pressure stage compressor body 1 can be blown off to the atmosphere when the low-pressure stage blow-off two-way valve 21 is opened. Thereby, a volume of compressed air supplied to the high-pressure stage compressor body 2 can be reduced. In addition, when the suction throttle valve 31 is conformed to the rated power, the suction throttle valve must be controlled so as to prevent discharge pressure of the low-pressure stage compressor body from becoming negative.

When only a small volume of compressed air is supplied to the usage side during low-load operation, the controller 18 gives a command to the inverter 8 to have the rotational speeds of the low-pressure stage compressor body 1 and the high-pressure stage compressor body 2 assuming lower limit values. Also, the controller 18 controls the suction throttle valve 31 and the blow-off two-way valves 21 and 32 so that the above-described no-load operation and load operation are repeated.

FIG. 5 shows pressures of respective portions of the oil free screw compressor in the embodiment. FIG. 5 shows a state at the time of no-load operation. An abscissa represents ratios relative to the rated rotational speed. It is found that when the rotational speed of the low-pressure stage compressor body 1 comes to about 60% or less of the rated value, pressure of compressed air discharged from the low-pressure stage compressor body 1 exceeds the atmospheric pressure. Therefore, it is found that during no-load operation, in which the rotational speed is set at 50% of the rated speed, compressed air compressed by the low-pressure stage compressor body 1 can be blown off to the atmosphere.

As described above in details, according to the present invention, in the oil free screw compressor having variable rotational speed type two-stage compressor bodies, compressed air can be blown off to the atmosphere from between the low-pressure stage compressor body and the high-pressure stage compressor body at the time of no-load operation, so that power consumption of the oil free screw compressor with no load can be reduced significantly. Further, it is possible to reduce power consumption also at the time of low-load operation, in which no-load operation and load operation with the set lower limit rotational speed are repeated.

What is claimed is:

1. A variable rotational speed oil free screw compressor, comprising:

a low-pressure stage compressor body and a high-pressure stage compressor body, which are variable in rotational speed; and a first blow-off valve for blowing off compressed air to the atmosphere midway a pipe connecting between said high-pressure stage compressor body and said low-pressure stage compressor body, the first blow-off valve blowing off the compressed air to the atmosphere when the low-pressure stage compressor body is operated at a set lower limit rotational speed in a no-load operation.

2. The variable rotational speed oil free screw compressor according to claim 1, further comprising an inter-cooler provided midway the pipe connecting between said high-pressure stage compressor body and said low-pressure stage compressor body, and an after-cooler provided on a discharge side of said high-pressure stage compressor body.

3. The variable rotational speed oil free screw compressor according to claim 1 or 2, further comprising a pressure detector provided on the discharge side of said high-pressure stage compressor body for detecting pressure of high-pressure air discharged from said high-pressure stage compressor body, and a controller provided to receive a signal of discharge pressure detected by said pressure detector and output a control signal for controlling said first blow-off valve.

4. The variable rotational speed oil free screw compressor according to claim 3, further comprising an electric motor for rotatingly driving said low-pressure stage compressor body and said high-pressure stage compressor body, and an inverter for driving said electric motor, and wherein said controller controls said inverter based on a signal of discharge pressure detected by said pressure detector.

5. The variable rotational speed oil free screw compressor according to claim 3, further comprising a suction throttle valve provided on a suction side of said low-pressure stage compressor body, and a second blow-off valve provided on a discharge side of said high-pressure stage compressor body, said second blow-off valve interconnecting with said suction throttle valve.

6. A method of controlling a variable rotational speed oil free screw compressor adapted to operate in accordance with a volume of consumed air on a usage side while changing rotational speeds of a low-pressure stage compressor body and a high-pressure stage compressor body, the method comprising the steps of: performing a load operation to change rotational speeds of said low-pressure stage compressor body and said high-pressure stage compressor body in a region, in which a volume of consumed air based on pressure detected by a pressure detector provided on a discharge side ranges from a maximum air volume to a preset volume of air; operating said low-pressure stage compressor body and said high-pressure stage compressor body at set lower limit rotational speeds preset every compressor body in a no-load operation, in which a volume of consumed air is substantially zero, and blowing off compressed air from a first blow-off valve provided in a pipe connecting between said high-pressure stage compressor body and said low-pressure stage compressor body; and repeating said load operation and said no-load operation when a volume of consumed air is equal to or smaller than a set air volume.

7. The method of controlling an oil free screw compressor operating at variable speeds, according to claim 6, wherein during said load operation, the rotational speeds of said low-pressure stage compressor body and said high-pressure stage compressor body are changed substantially in proportion to a volume of consumed air.

8. The method of controlling an oil free screw compressor operating at variable speeds, according to claim 7, wherein compressed air discharged from said high-pressure stage compressor body is blown off during said no-load operation.

9. The method of controlling a variable rotational speed oil free screw compressor, according to claim 6, wherein compressed air discharged from said high-pressure stage compressor body is blown off during said no-load operation.

10. A method of controlling a variable rotational speed oil free screw compressor adapted to operate in accordance with a volume of consumed air on a usage side while changing rotational speeds of a low-pressure stage compressor body and a high-pressure stage compressor body, the method comprising the steps of: performing operations including a no-load operation to blow off compressed air from a first blow-off valve provided in a pipe connecting between said high-pressure stage compressor body and said low-pressure stage compressor body when a volume of consumed air based on pressure detected by a pressure detector provided on a discharge side is at most a preset volume of air and pressure of compressed air discharged from said low-pressure stage compressor body is at least the atmospheric pressure.

11. The method of controlling an oil free screw compressor operating at variable speeds, according to claim 10, further comprising interlocking a suction throttle valve provided on a suction side of said low-pressure stage compressor body with a second blow-off valve for compressed air compressed by said high-pressure stage compressor body to make control to throttle said suction throttle valve when a volume of consumed air is at most a set air volume.

12. The variable rotational speed oil free screw compressor according to claim 1, further comprising a second blow-off valve provided between said high-pressure stage compressor body and a check valve to blow off compressed air discharged from said high-pressure stage compressor body, and wherein compressed air is blown off through said first blow-off valve and said second blow-off valve at the time of no-load or low-load operation.

13. A variable rotational speed oil free screw compressor system, comprising:

a low-pressure stage screw compressor having male and female rotors held in a casing;

a high-pressure stage screw compressor having male and female rotors held in a casing;

a pipe connecting a discharge side of the low-pressure stage screw compressor to a suction side of the high-pressure stage screw compressor;

a variable speed motor for rotating the male and female rotors of the low-pressure and high-pressure stage screw compressors;

an inverter for driving the motor at varying speeds;

a low pressure stage blow-off valve for releasing compressed air from the pipe connecting the discharge side of the low-pressure stage screw compressor to the suction side of the high pressure stage screw compressor to atmosphere; and a controller for opening the low pressure stage blow-off valve to discharge compressed air to the atmosphere during no-load operation.

14. The variable rotational speed oil free screw compressor system according to claim 13, further comprising a pressure detector provided on a discharge side of the high-pressure stage screw compressor for detecting a discharge pressure of air discharged from the high-pressure stage screw compressor, the pressure detector being operably connected to the controller for sending a signal of discharge pressure to the controller.

15. The variable rotational speed oil free screw compressor system according to claim 14, wherein the controller controls the inverter to drive the male and female rotors of the low-pressure and high-pressure stage screw compressors at a reduced rotational speed in proportion to a volume of discharged air when a volume of discharged air is a predetermined volume or less.

16. The variable rotational speed oil free screw compressor system according to claim 14, further comprising a discharge air pipe for discharging high-pressure air from the discharge side of the high-pressure stage screw compressor to a usage side, and a high-pressure stage blow-off valve for discharging high-pressure compressed air from between the discharge side of the high-pressure stage screw compressor and the discharge pipe to atmosphere, wherein the controller opens the high-pressure stage blow-off valve when the pressure detector detects a discharge pressure exceeding a set upper limit.

17. The variable rotational speed oil free screw compressor system according to claim 16, further comprising an after cooler provided between the discharge side of the high-pressure stage screw compressor and the discharge pipe, wherein the high-pressure stage blow-off valve is provided between the discharge side of the high-pressure stage screw compressor and the after-cooler.

18. The variable rotational speed oil free screw compressor system according to claim 13, further comprising an inter-cooler provided in the pipe connecting the discharge side of the low-pressure stage screw compressor and the suction side of the high-pressure screw compressor, wherein the low-pressure stage blow-off valve is between the discharge side of the low-pressure stage screw compressor and the inter-cooler.

* * * * *